US008490674B2

(12) United States Patent
Stevens et al.

(10) Patent No.: US 8,490,674 B2
(45) Date of Patent: Jul. 23, 2013

(54) METHODS OF FORMING AT LEAST A PORTION OF EARTH-BORING TOOLS

(75) Inventors: John H. Stevens, Hannover (DE); Jimmy W. Eason, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/111,666

(22) Filed: May 19, 2011

(65) Prior Publication Data

US 2011/0284179 A1 Nov. 24, 2011

Related U.S. Application Data

(60) Provisional application No. 61/346,699, filed on May 20, 2010.

(51) Int. Cl.
*B22D 27/00* (2006.01)
*B22D 19/14* (2006.01)

(52) U.S. Cl.
USPC ..... 164/55.1; 164/97

(58) Field of Classification Search
USPC ..... 164/55.1, 56.1, 57.1, 58.1, 97, 98
See application file for complete search history.

(56) References Cited

U.S. PATENT DOCUMENTS

| | | | |
|---|---|---|---|
| 2,299,207 | A | 10/1942 | Bevillard |
| 2,819,958 | A | 1/1958 | Abkowitz et al. |
| 2,819,959 | A | 1/1958 | Abkowitz et al. |
| 2,906,654 | A | 9/1959 | Abkowitz |
| 3,368,881 | A | 2/1968 | Abkowitz et al. |
| 3,471,921 | A | 10/1969 | Feenstra |
| 3,660,050 | A | 5/1972 | Iler et al. |
| 3,757,879 | A | 9/1973 | Wilder et al. |
| 3,800,891 | A | 4/1974 | White et al. |
| 3,942,954 | A | 3/1976 | Frehn |
| 3,987,859 | A | 10/1976 | Lichte |
| 4,017,480 | A | 4/1977 | Baum |

(Continued)

FOREIGN PATENT DOCUMENTS

| | | |
|---|---|---|
| AU | 695583 | 2/1998 |
| CA | 2212197 | 10/2000 |

(Continued)

OTHER PUBLICATIONS

US 4,966,627 Sep. 11, 1990 Keshavan et al. "withdrawn."

(Continued)

*Primary Examiner* — Kevin P Kerns
(74) *Attorney, Agent, or Firm* — TraskBritt

(57) ABSTRACT

Methods of forming at least a portion of an earth-boring tool include providing particulate matter comprising a hard material in a mold cavity, melting a metal and the hard material to form a molten composition comprising a eutectic or near-eutectic composition of the metal and the hard material, casting the molten composition to form the at least a portion of an earth-boring tool within the mold cavity, and adjusting a stoichiometry of at least one hard material phase of the at least a portion of the earth-boring tool. Methods of forming a roller cone of an earth-boring rotary drill bit include forming a molten composition, casting the molten composition within a mold cavity, solidifying the molten composition to form the roller cone, and converting an eta-phase region within the roller cone to at least one of WC and $W_2C$.

16 Claims, 4 Drawing Sheets

U.S. PATENT DOCUMENTS

| | | | |
|---|---|---|---|
| 4,047,828 | A | 9/1977 | Makely |
| 4,094,709 | A | 6/1978 | Rozmus |
| 4,128,136 | A | 12/1978 | Generoux |
| 4,198,233 | A | 4/1980 | Frehn |
| 4,221,270 | A | 9/1980 | Vezirian |
| 4,229,638 | A | 10/1980 | Lichte |
| 4,233,720 | A | 11/1980 | Rozmus |
| 4,255,165 | A | 3/1981 | Dennis et al. |
| 4,276,788 | A | 7/1981 | van Nederveen |
| 4,306,139 | A | 12/1981 | Shinozaki et al. |
| 4,334,928 | A | 6/1982 | Hara et al. |
| 4,341,557 | A | 7/1982 | Lizenby |
| 4,351,401 | A | 9/1982 | Fielder |
| 4,389,952 | A | 6/1983 | Dreier et al. |
| 4,398,952 | A | 8/1983 | Drake |
| 4,423,646 | A | 1/1984 | Bernhardt |
| 4,499,048 | A | 2/1985 | Hanejko |
| 4,499,795 | A | 2/1985 | Radtke |
| 4,520,882 | A | 6/1985 | van Nederveen |
| 4,526,748 | A | 7/1985 | Rozmus |
| 4,547,337 | A | 10/1985 | Rozmus |
| 4,552,232 | A | 11/1985 | Frear |
| 4,554,130 | A | 11/1985 | Ecer |
| 4,562,990 | A | 1/1986 | Rose |
| 4,579,713 | A | 4/1986 | Lueth |
| 4,596,694 | A | 6/1986 | Rozmus |
| 4,597,456 | A | 7/1986 | Ecer |
| 4,597,730 | A | 7/1986 | Rozmus |
| 4,630,693 | A | 12/1986 | Goodfellow |
| 4,656,002 | A | 4/1987 | Lizenby et al. |
| 4,667,756 | A | 5/1987 | King et al. |
| 4,686,080 | A | 8/1987 | Hara et al. |
| 4,694,919 | A | 9/1987 | Barr |
| 4,743,515 | A | 5/1988 | Fischer et al. |
| 4,744,943 | A | 5/1988 | Timm |
| 4,780,274 | A | 10/1988 | Barr |
| 4,804,049 | A | 2/1989 | Barr |
| 4,809,903 | A | 3/1989 | Eylon et al. |
| 4,838,366 | A | 6/1989 | Jones |
| 4,871,377 | A | 10/1989 | Frushour |
| 4,884,477 | A | 12/1989 | Smith et al. |
| 4,889,017 | A | 12/1989 | Fuller et al. |
| 4,899,838 | A | 2/1990 | Sullivan et al. |
| 4,919,013 | A | 4/1990 | Smith et al. |
| 4,923,512 | A | 5/1990 | Timm et al. |
| 4,956,012 | A | 9/1990 | Jacobs et al. |
| 4,968,348 | A | 11/1990 | Abkowitz et al. |
| 4,991,670 | A | 2/1991 | Fuller et al. |
| 5,000,273 | A | 3/1991 | Horton et al. |
| 5,010,945 | A | 4/1991 | Burke |
| 5,030,598 | A | 7/1991 | Hsieh |
| 5,032,352 | A | 7/1991 | Meeks et al. |
| 5,049,450 | A | 9/1991 | Dorfman et al. |
| 5,090,491 | A | 2/1992 | Tibbitts et al. |
| 5,092,412 | A | 3/1992 | Walk |
| 5,161,898 | A | 11/1992 | Drake |
| 5,232,522 | A | 8/1993 | Doktycz et al. |
| 5,281,260 | A | 1/1994 | Kumar et al. |
| 5,286,685 | A | 2/1994 | Schoennahl et al. |
| 5,311,958 | A | 5/1994 | Isbell et al. |
| 5,348,806 | A | 9/1994 | Kojo et al. |
| 5,373,907 | A | 12/1994 | Weaver |
| 5,433,280 | A | 7/1995 | Smith |
| 5,443,337 | A | 8/1995 | Katayama |
| 5,452,771 | A | 9/1995 | Blackman et al. |
| 5,479,997 | A | 1/1996 | Scott et al. |
| 5,482,670 | A | 1/1996 | Hong |
| 5,484,468 | A | 1/1996 | Ostlund et al. |
| 5,506,055 | A | 4/1996 | Dorfman et al. |
| 5,518,077 | A | 5/1996 | Blackman et al. |
| 5,525,134 | A | 6/1996 | Mehrotra et al. |
| 5,543,235 | A | 8/1996 | Mirchandani et al. |
| 5,544,550 | A | 8/1996 | Smith |
| 5,560,440 | A | 10/1996 | Tibbitts |
| 5,586,612 | A | 12/1996 | Isbell et al. |
| 5,593,474 | A | 1/1997 | Keshavan et al. |
| 5,611,251 | A | 3/1997 | Katayama |
| 5,612,264 | A | 3/1997 | Nilsson et al. |
| 5,641,251 | A | 6/1997 | Leins et al. |
| 5,641,921 | A | 6/1997 | Dennis et al. |
| 5,662,183 | A | 9/1997 | Fang |
| 5,666,864 | A | 9/1997 | Tibbitts |
| 5,677,042 | A | 10/1997 | Massa et al. |
| 5,679,445 | A | 10/1997 | Massa et al. |
| 5,697,046 | A | 12/1997 | Conley |
| 5,697,462 | A | 12/1997 | Grimes et al. |
| 5,732,783 | A | 3/1998 | Truax et al. |
| 5,733,649 | A | 3/1998 | Kelley et al. |
| 5,733,664 | A | 3/1998 | Kelley et al. |
| 5,753,160 | A | 5/1998 | Takeuchi et al. |
| 5,755,298 | A | 5/1998 | Langford, Jr. et al. |
| 5,765,095 | A | 6/1998 | Flak et al. |
| 5,776,593 | A | 7/1998 | Massa et al. |
| 5,778,301 | A | 7/1998 | Hong |
| 5,789,686 | A | 8/1998 | Massa et al. |
| 5,792,403 | A | 8/1998 | Massa et al. |
| 5,803,152 | A | 9/1998 | Dolman et al. |
| 5,806,934 | A | 9/1998 | Massa et al. |
| 5,830,256 | A | 11/1998 | Northrop et al. |
| 5,856,626 | A | 1/1999 | Fischer et al. |
| 5,865,571 | A | 2/1999 | Tankala et al. |
| 5,866,254 | A | 2/1999 | Peker et al. |
| 5,880,382 | A | 3/1999 | Fang et al. |
| 5,893,204 | A | 4/1999 | Symonds |
| 5,897,830 | A | 4/1999 | Abkowitz et al. |
| 5,899,257 | A | 5/1999 | Alleweireldt et al. |
| 5,957,006 | A | 9/1999 | Smith |
| 5,963,775 | A | 10/1999 | Fang |
| 6,029,544 | A | 2/2000 | Katayama |
| 6,051,171 | A | 4/2000 | Takeuchi et al. |
| 6,063,333 | A | 5/2000 | Dennis |
| 6,068,070 | A | 5/2000 | Scott |
| 6,073,518 | A | 6/2000 | Chow et al. |
| 6,086,980 | A | 7/2000 | Foster et al. |
| 6,089,123 | A | 7/2000 | Chow et al. |
| 6,109,377 | A | 8/2000 | Massa et al. |
| 6,109,677 | A | 8/2000 | Anthony |
| 6,135,218 | A | 10/2000 | Deane et al. |
| 6,148,936 | A | 11/2000 | Evans et al. |
| 6,200,514 | B1 | 3/2001 | Meister |
| 6,209,420 | B1 | 4/2001 | Butcher et al. |
| 6,214,134 | B1 | 4/2001 | Eylon et al. |
| 6,214,287 | B1 | 4/2001 | Waldenstrom |
| 6,220,117 | B1 | 4/2001 | Butcher |
| 6,227,188 | B1 | 5/2001 | Tankala et al. |
| 6,228,139 | B1 | 5/2001 | Oskarsson |
| 6,241,036 | B1 | 6/2001 | Lovato et al. |
| 6,254,658 | B1 | 7/2001 | Taniuchi et al. |
| 6,287,360 | B1 | 9/2001 | Kembaiyan et al. |
| 6,290,438 | B1 | 9/2001 | Papajewski |
| 6,293,986 | B1 | 9/2001 | Rodiger et al. |
| 6,302,224 | B1 | 10/2001 | Sherwood, Jr. |
| 6,353,771 | B1 | 3/2002 | Southland |
| 6,372,346 | B1 | 4/2002 | Toth |
| 6,375,706 | B2 | 4/2002 | Kembaiyan et al. |
| 6,453,899 | B1 | 9/2002 | Tselesin |
| 6,454,025 | B1 | 9/2002 | Runquist et al. |
| 6,454,028 | B1 | 9/2002 | Evans |
| 6,454,030 | B1 | 9/2002 | Findley et al. |
| 6,458,471 | B2 | 10/2002 | Lovato et al. |
| 6,474,425 | B1 | 11/2002 | Truax et al. |
| 6,500,226 | B1 | 12/2002 | Dennis |
| 6,511,265 | B1 | 1/2003 | Mirchandani et al. |
| 6,546,991 | B2 | 4/2003 | Dworog et al. |
| 6,576,182 | B1 | 6/2003 | Ravagni et al. |
| 6,589,640 | B2 | 7/2003 | Griffin et al. |
| 6,599,467 | B1 | 7/2003 | Yamaguchi et al. |
| 6,607,693 | B1 | 8/2003 | Saito et al. |
| 6,651,757 | B2 | 11/2003 | Belnap et al. |
| 6,655,481 | B2 | 12/2003 | Findley et al. |
| 6,655,882 | B2 | 12/2003 | Heinrich et al. |
| 6,685,880 | B2 | 2/2004 | Engstrom et al. |
| 6,742,608 | B2 | 6/2004 | Murdoch |
| 6,742,611 | B1 | 6/2004 | Illerhaus et al. |
| 6,756,009 | B2 | 6/2004 | Sim et al. |
| 6,766,870 | B2 | 7/2004 | Overstreet |
| 6,767,505 | B2 | 7/2004 | Witherspoon et al. |

| | | | |
|---|---|---|---|
| 6,782,958 | B2 | 8/2004 | Liang et al. |
| 6,799,648 | B2 | 10/2004 | Brandenberg et al. |
| 6,849,231 | B2 | 2/2005 | Kojima et al. |
| 6,918,942 | B2 | 7/2005 | Hatta et al. |
| 7,044,243 | B2 | 5/2006 | Kembaiyan et al. |
| 7,048,081 | B2 | 5/2006 | Smith et al. |
| 7,250,069 | B2 | 7/2007 | Kembaiyan et al. |
| 7,261,782 | B2 | 8/2007 | Hwang et al. |
| 7,270,679 | B2 | 9/2007 | Istephanous et al. |
| 7,556,668 | B2 | 7/2009 | Eason et al. |
| 7,661,491 | B2 | 2/2010 | Kembaiyan et al. |
| 7,687,156 | B2 | 3/2010 | Fang et al. |
| 7,954,569 | B2 | 6/2011 | Mirchandani et al. |
| 8,020,640 | B2 | 9/2011 | Lockwood et al. |
| 8,201,610 | B2 | 6/2012 | Stevens et al. |
| 2002/0004105 | A1 | 1/2002 | Kunze et al. |
| 2002/0020564 | A1 | 2/2002 | Fang et al. |
| 2002/0175006 | A1 | 11/2002 | Findley et al. |
| 2003/0010409 | A1 | 1/2003 | Kunze et al. |
| 2003/0041922 | A1 | 3/2003 | Hirose et al. |
| 2003/0219605 | A1 | 11/2003 | Molian et al. |
| 2004/0013558 | A1 | 1/2004 | Kondoh et al. |
| 2004/0060742 | A1 | 4/2004 | Kembaiyan et al. |
| 2004/0149494 | A1 | 8/2004 | Kembaiyan et al. |
| 2004/0196638 | A1 | 10/2004 | Lee et al. |
| 2004/0243241 | A1 | 12/2004 | Istephanous et al. |
| 2004/0244540 | A1 | 12/2004 | Oldham et al. |
| 2004/0245022 | A1 | 12/2004 | Izaguirre et al. |
| 2004/0245024 | A1 | 12/2004 | Kembaiyan |
| 2005/0008524 | A1 | 1/2005 | Testani |
| 2005/0072496 | A1 | 4/2005 | Hwang et al. |
| 2005/0084407 | A1 | 4/2005 | Myrick |
| 2005/0117984 | A1 | 6/2005 | Eason et al. |
| 2005/0126334 | A1 | 6/2005 | Mirchandani |
| 2005/0211475 | A1* | 9/2005 | Mirchandani et al. ..... 175/426 |
| 2005/0247491 | A1 | 11/2005 | Mirchandani et al. |
| 2005/0268746 | A1 | 12/2005 | Abkowitz et al. |
| 2006/0016521 | A1 | 1/2006 | Hanusiak et al. |
| 2006/0032335 | A1 | 2/2006 | Kembaiyan |
| 2006/0032677 | A1 | 2/2006 | Azar et al. |
| 2006/0043648 | A1 | 3/2006 | Takeuchi et al. |
| 2006/0057017 | A1 | 3/2006 | Woodfield et al. |
| 2006/0131081 | A1 | 6/2006 | Mirchandani et al. |
| 2007/0042217 | A1 | 2/2007 | Fang et al. |
| 2007/0056777 | A1 | 3/2007 | Overstreet |
| 2007/0102198 | A1 | 5/2007 | Oxford et al. |
| 2007/0102199 | A1 | 5/2007 | Smith et al. |
| 2007/0102200 | A1 | 5/2007 | Choe et al. |
| 2007/0102202 | A1 | 5/2007 | Choe et al. |
| 2007/0151770 | A1 | 7/2007 | Ganz |
| 2007/0193782 | A1 | 8/2007 | Fang et al. |
| 2007/0277651 | A1 | 12/2007 | Calnan et al. |
| 2008/0011519 | A1 | 1/2008 | Smith et al. |
| 2008/0028891 | A1 | 2/2008 | Calnan et al. |
| 2008/0101977 | A1 | 5/2008 | Eason et al. |
| 2008/0163723 | A1 | 7/2008 | Mirchandani et al. |
| 2008/0302576 | A1 | 12/2008 | Mirchandani et al. |
| 2009/0301788 | A1 | 12/2009 | Stevens et al. |
| 2010/0193252 | A1 | 8/2010 | Mirchandani et al. |
| 2011/0287238 | A1* | 11/2011 | Stevens et al. ..... 428/212 |
| 2011/0287924 | A1* | 11/2011 | Stevens ..... 501/87 |

FOREIGN PATENT DOCUMENTS

| | | | |
|---|---|---|---|
| EP | 0264674 | A2 | 4/1988 |
| EP | 0453428 | A1 | 10/1991 |
| EP | 0995876 | A2 | 4/2000 |
| EP | 1244531 | B1 | 10/2002 |
| GB | 945227 | | 12/1963 |
| GB | 2315452 | A | 2/1998 |
| GB | 2384745 | A | 8/2003 |
| GB | 2385350 | A | 8/2003 |
| GB | 2393449 | A | 3/2004 |
| JP | 5064288 | | 8/1993 |
| JP | 10219385 | A | 8/1998 |
| UA | 6742 | | 12/1994 |
| UA | 63469 | | 1/2006 |
| UA | 23749 | U | 11/2007 |
| WO | 03049889 | A2 | 6/2003 |
| WO | 2004053197 | A2 | 6/2004 |
| WO | 2007127899 | A2 | 11/2007 |

OTHER PUBLICATIONS

US 7,717,198, 03/2010, Eason et al. (withdrawn).

International Search Report and Written Opinion for PCT/US2005/014742, completed Jul. 25, 2005.

International Preliminary Report on Patentability for PCT/US2005/014742,dated Nov. 1, 2006.

Sims et al., Superalloys II, Casting Engineering, Aug. 1987, pp. 420-426.

Sikkenga, Cobalt and Cobalt Alloy Castings, Casting, vol. 15, ASM Handbook, ASM International, 2008, pp. 1114-1118.

Pyrotek, Zyp Zircwash, www.pyrotek.info, no date, 1 page.

Amperweld, Surface Technology, Powders for PTA-Welding, Lasercladding and other Wear Protective Welding Applications, H.C. Starck Empowering High Tech Materials, 4 pages.

International Search Report for International Application No. PCT/US2011/037196 mailed Nov. 11, 2011, 4 pages.

International Written Opinion for International Application No. PCT/US2011/037196 mailed Nov. 11, 2011, 4 pages.

International Preliminary Report on Patentability for International Application No. PCT/US2011/037196 dated Nov. 20, 2012, 5 pages.

* cited by examiner

METHODS OF FORMING AT LEAST A PORTION OF EARTH-BORING TOOLS

CROSS-REFERENCE TO RELATED APPLICATIONS

This application claims the benefit of U.S. Provisional Patent Application Ser. No. 61/346,699, filed May 20, 2010 and entitled "Casting Methods for the Fabrication of Earth-Boring Tools and Components of Such Tools, and Earth-Boring Tools and Components of Such Tools Formed by Such Methods," the disclosure of which is incorporated herein in its entirety by this reference.

The subject matter of this application is related to the subject matter of U.S. patent application Ser. No. 10/848,437, abandoned which was filed May 18, 2004 and entitled "Earth-Boring Bits," as well as to the subject matter of U.S. patent application Ser. No. 11/116,752, which was filed Apr. 28, 2005 issued as U.S. Pat. No. 7,954,569 on Jun. 7, 2011, and entitled "Earth-Boring Bits," the disclosures of each of which are incorporated herein in their entirety by this reference. The subject matter of this application is also related to the subject matter of U.S. patent application Ser. No. 13/111,739, pending, filed on May 19, 2011, and titled "Methods of Forming at Least a Portion of Earth-Boring Tools, and Articles Formed by Such Methods;" U.S. patent application Ser. No. 13/111,783, pending, on filed May 19, 2011, and titled "Methods of Forming at Least a Portion of Earth-Boring Tools, and Articles and Formed by Such Methods;" and U.S. Pat. No. 8,201,610, issued on Jun. 19, 2012, the entire disclosure of each of which is incorporated herein by reference.

TECHNICAL FIELD

Embodiments of the present disclosure relate to earth-boring tools, such as earth-boring rotary drill bits, to components of such tools, and to methods of manufacturing such earth-boring tools and components thereof.

BACKGROUND

Earth-boring tools are commonly used for forming (e.g., drilling and reaming) bore holes or wells (hereinafter "wellbores") in earth formations. Earth-boring tools include, for example, rotary drill bits, core bits, eccentric bits, bicenter bits, reamers, underreamers, and mills.

Different types of earth-boring rotary drill bits are known in the art including, for example, fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore.

The drill bit is coupled, either directly or indirectly, to an end of what is referred to in the art as a "drill string," which comprises a series of elongated tubular segments connected end-to-end and extends into the wellbore from the surface of the formation. Often various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore.

Rolling-cutter drill bits typically include three roller cones mounted on supporting bit legs that extend from a bit body, which may be formed from, for example, three bit head sections that are welded together to form the bit body. Each bit leg may depend from one bit head section. Each roller cone is configured to spin or rotate on a bearing shaft that extends from a bit leg in a radially inward and downward direction from the bit leg. The cones are typically formed from steel, but they also may be formed from a particle-matrix composite material (e.g., a cermet composite such as cemented tungsten carbide). Cutting teeth for cutting rock and other earth formations may be machined or otherwise formed in or on the outer surfaces of each cone. Alternatively, receptacles are formed in outer surfaces of each cone, and inserts formed of hard, wear resistant material are secured within the receptacles to form the cutting elements of the cones. As the rolling-cutter drill bit is rotated within a wellbore, the roller cones roll and slide across the surface of the formation, which causes the cutting elements to crush and scrape away the underlying formation.

Fixed-cutter drill bits typically include a plurality of cutting elements that are attached to a face of a bit body. The bit body may include a plurality of wings or blades, which define fluid courses between the blades. The cutting elements may be secured to the bit body within pockets formed in outer surfaces of the blades. The cutting elements are attached to the bit body in a fixed manner, such that the cutting elements do not move relative to the bit body during drilling. The bit body may be formed from steel or a particle-matrix composite material (e.g., cobalt-cemented tungsten carbide). In embodiments in which the bit body comprises a particle-matrix composite material, the bit body may be attached to a metal alloy (e.g., steel) shank having a threaded end that may be used to attach the bit body and the shank to a drill string. As the fixed-cutter drill bit is rotated within a wellbore, the cutting elements scrape across the surface of the formation and shear away the underlying formation.

Impregnated diamond rotary drill bits may be used for drilling hard or abrasive rock formations such as sandstones. Typically, an impregnated diamond drill bit has a solid head or crown that is cast in a mold. The crown is attached to a steel shank that has a threaded end that may be used to attach the crown and steel shank to a drill string. The crown may have a variety of configurations and generally includes a cutting face comprising a plurality of cutting structures, which may comprise at least one of cutting segments, posts, and blades. The posts and blades may be integrally formed with the crown in the mold, or they may be separately formed and attached to the crown. Channels separate the posts and blades to allow drilling fluid to flow over the face of the bit.

Impregnated diamond bits may be formed such that the cutting face of the drill bit (including the posts and blades) comprises a particle-matrix composite material that includes diamond particles dispersed throughout a matrix material. The matrix material itself may comprise a particle-matrix composite material, such as particles of tungsten carbide, dispersed throughout a metal matrix material, such as a copper-based alloy.

It is known in the art to apply wear-resistant materials, such as "hardfacing" materials, to the formation-engaging surfaces of rotary drill bits to minimize wear of those surfaces of the drill bits cause by abrasion. For example, abrasion occurs at the formation-engaging surfaces of an earth-boring tool when those surfaces are engaged with and sliding relative to the surfaces of a subterranean formation in the presence of the solid particulate material (e.g., formation cuttings and detritus) carried by conventional drilling fluid. For example, hardfacing may be applied to cutting teeth on the cones of roller cone bits, as well as to the gage surfaces of the cones. Hardfacing also may be applied to the exterior surfaces of the curved lower end or "shirttail" of each bit leg, and other exterior surfaces of the drill bit that are likely to engage a formation surface during drilling.

BRIEF SUMMARY

In some embodiments, the invention includes a method of forming at least a portion of an earth-boring tool. The method comprises providing particulate matter comprising a hard material in a mold cavity, melting a metal and the hard material to for in a molten composition comprising a eutectic or near-eutectic composition of the metal and the hard material, casting the molten composition to form at least a portion of an earth-boring tool within the mold cavity, and adjusting a stoichiometry of at least one hard material phase of the at least a portion of the earth-boring tool.

In other embodiments, methods of forming a roller cone of an earth-boring rotary drill bit comprise forming a molten composition comprising a eutectic or near-eutectic composition of cobalt and tungsten carbide, casting the molten composition within a mold cavity, solidifying the molten composition within the mold cavity to form the roller cone, and converting an eta-phase region within the roller cone to at least one of WC and $W_2C$.

BRIEF DESCRIPTION OF THE DRAWINGS

While the specification concludes with claims particularly pointing out and distinctly claiming what are regarded as embodiments of the present invention, various features and advantages of this disclosure may be more readily ascertained from the following description of example embodiments provided with reference to the accompanying drawings, in which:

DETAILED DESCRIPTION

Figure 1:
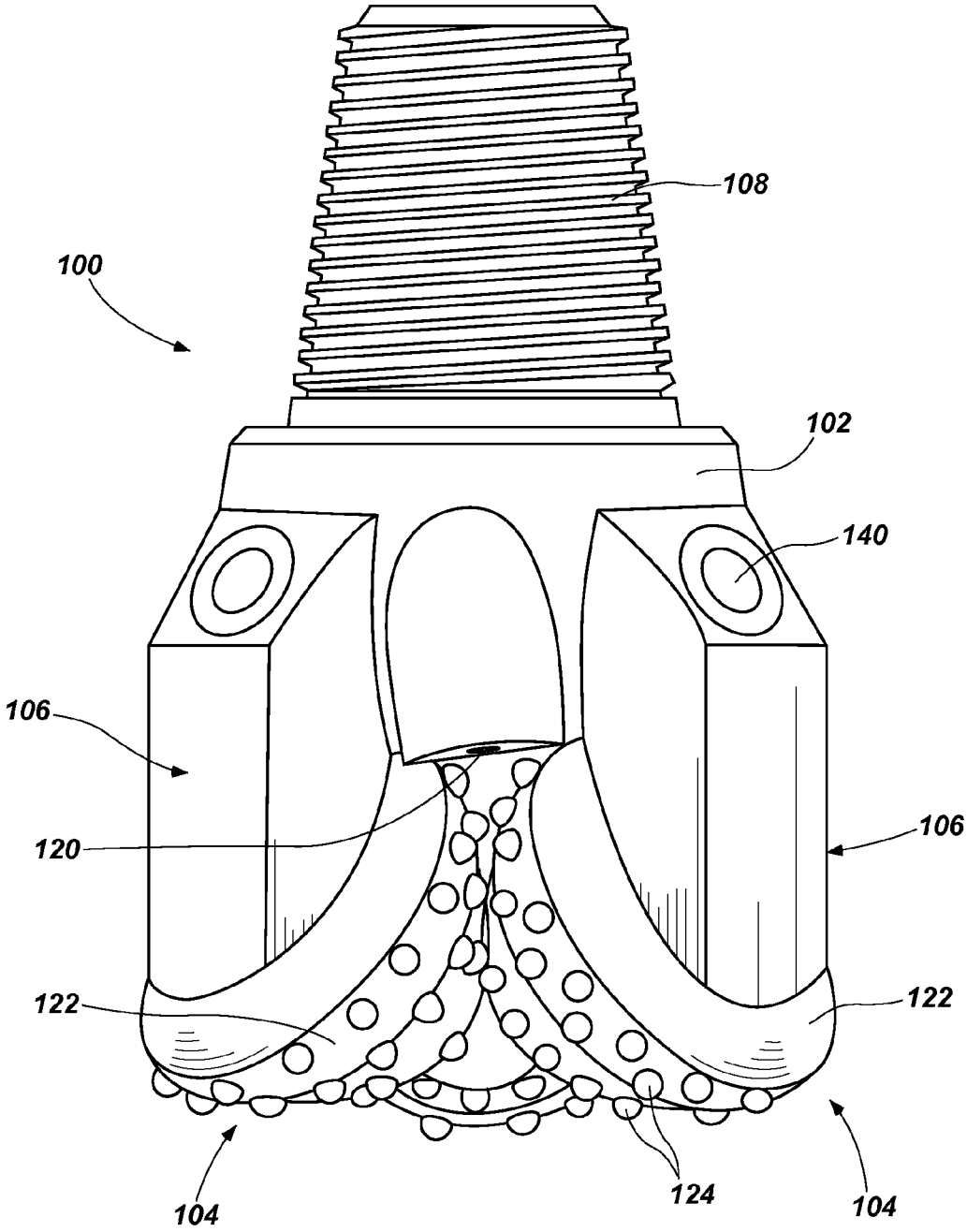
FIG. 1 is a side elevation view of an embodiment of a rolling-cutter drill bit that may include one or more components comprising a cast particle-matrix composite material including a eutectic or near-eutectic composition.

The illustrations presented herein are not actual views of any particular earth-boring tool, drill bit, or component of such a tool or bit, but are merely idealized representations that are employed to describe embodiments of the present disclosure.

As used herein, the term earth-boring tool means and includes any tool used to remove formation material and form a bore (e.g., a wellbore) through the formation by way of the removal of the formation material. Earth-boring tools include, for example, rotary drill bits (e.g., fixed-cutter or "drag" bits and roller cone or "rock" bits), hybrid bits including both fixed cutters and roller elements, coring bits, percussion bits, bi-center bits, reamers (including expandable reamers and fixed-wing reamers), and other so-called "hole-opening" tools.

As used herein, the term "cutting element" means and includes any element of an earth-boring tool that is used to cut or otherwise disintegrate formation material when the earth-boring tool is used to form or enlarge a bore in the formation.

As used herein, the terms "cone" and "roller cone" mean and include any body comprising at least one formation-cutting structure that is mounted on a body of a rotary earth-boring tool, such as a rotary drill bit, in a rotatable manner, and that is configured to rotate relative to at least a portion of the body as the rotary earth-boring tool is rotated within a wellbore, and to remove formation material as the rotary earth-boring tool is rotated within a wellbore. Cones and roller cones may have a generally conical shape, but are not limited to structures having such a generally conical shape. Cones and roller cones may have shapes other than generally conical shapes.

In accordance with some embodiments of the present disclosure, earth-boring tools and/or components of earth-boring tools may comprise a cast particle-matrix composite material. The cast particle-matrix composite material may comprise a eutectic or near-eutectic composition. As used herein, the term "cast," when used in relation to a material, means a material that is formed within a mold cavity, such that a body formed to comprise the cast material is formed to comprise a shape at least substantially similar to the mold cavity in which the material is formed. Accordingly, the terms "cast" and "casting" are not limited to conventional casting, wherein a molten material is poured into a mold cavity, but encompass melting material in situ in a mold cavity. In addition, as is explained in more detail below, casting processes may be conducted at elevated, greater than atmospheric, pressure. Casting may also be performed at atmospheric pressure or at less than atmospheric pressure. As used herein, the term "near-eutectic composition" means within about ten atomic percent (10 at %) or less of a eutectic composition. As a non-limiting example, the cast particle-matrix composite material may comprise a eutectic or near-eutectic composition of cobalt and tungsten carbide. Examples of embodiments of earth-boring tools and components of earth-boring tools that may include a cast particle-matrix composite material comprising a eutectic or near-eutectic composition are described below.

Figure 2:
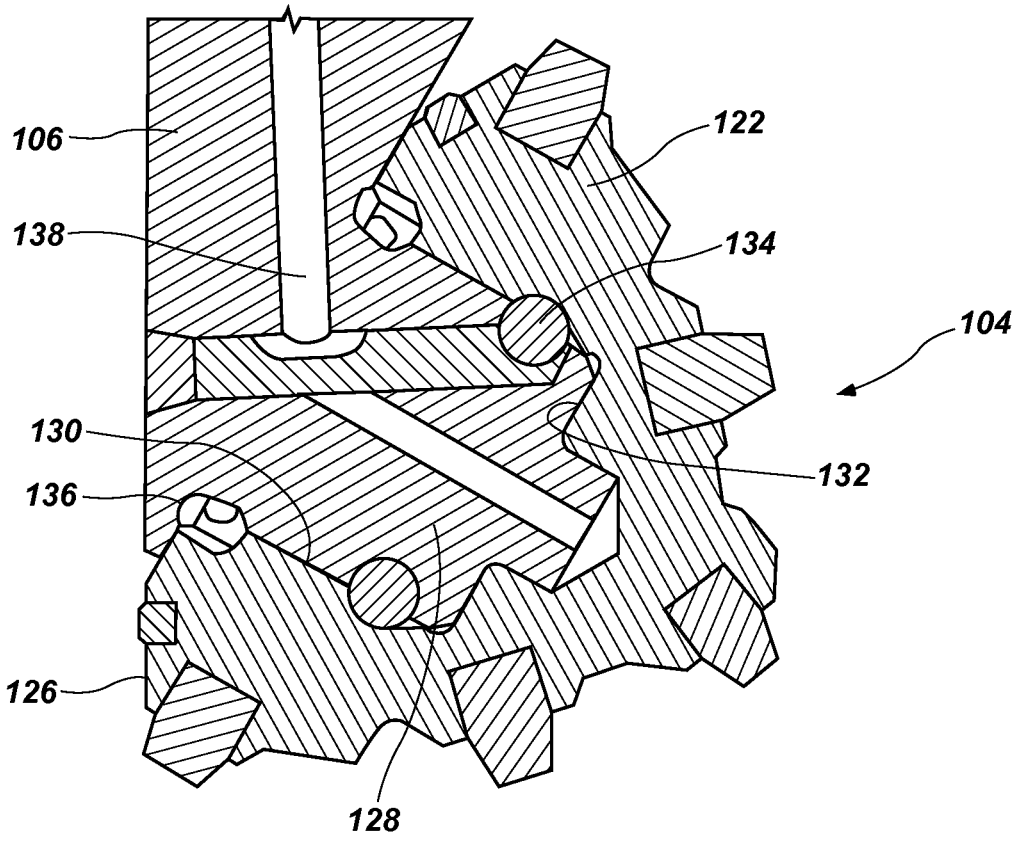
FIG. 2 is a partial sectional view of the drill bit of FIG. 1 and illustrates a rotatable cutter assembly that includes a roller cone.

FIG. 1 illustrates an embodiment of an earth-boring tool of the present disclosure. The earth-boring tool of FIG. 1 is a rolling-cutter earth-boring rotary drill bit 100. The drill bit 100 includes a bit body 102 and a plurality of rotatable cutter assemblies 104. The bit body 102 may include a plurality of integrally formed bit legs 106, and threads 108 may be formed on the upper end of the bit body 102 for connection to a drill string. The bit body 102 may have nozzles 120 for discharging drilling fluid into a borehole, which may be returned along with cuttings up to the surface during a drilling operation. Each of the rotatable cutter assemblies 104 includes a roller cone 122 comprising a particle-matrix composite material and a plurality of cutting elements, such as cutting inserts 124 shown. Each roller cone 122 may include a conical gage surface 126 (FIG. 2). Additionally, each roller cone 122 may have a unique configuration of cutting inserts 124 or cutting elements, such that the roller cones 122 may rotate in close proximity to one another without mechanical interference.

FIG. 2 is a cross-sectional view illustrating one of the rotatable cutter assemblies 104 of the earth-boring drill bit 100 shown in FIG. 1. As shown, each bit leg 106 may include a bearing pin 128. The roller cone 122 may be supported by the bearing pin 128, and the roller cone 122 may be rotatable about the bearing pin 128. Each roller cone 122 may have a central cavity 130 that may be cylindrical and may form a journal bearing surface adjacent the bearing pin 128. The cavity 130 may have a flat thrust shoulder 132 for absorbing thrust imposed by the drill string on the roller cone 122. As illustrated in this example, the roller cone 122 may be retained on the bearing pin 128 by a plurality of locking balls 134 located in mating grooves formed in the surfaces of the cone cavity 130 and the bearing pin 128. Additionally, a seal assembly 136 may seal the bearing spaces between the cone cavity 130 and the bearing pin 128. The seal assembly 136 may be a metal face seal assembly, as shown, or may be a different type of seal assembly, such as an elastomer seal assembly.

Lubricant may be supplied to the bearing spaces between the cavity 130 and the bearing pin 128 by lubricant passages 138. The lubricant passages 138 may lead to a reservoir that includes a pressure compensator 140 (FIG. 1).

At least one of the roller cones 122 and the bit legs 106 of the earth-boring drill bit 100 of FIGS. 1 and 2 may comprise a cast particle-matrix composite material comprising a eutectic or near-eutectic composition, and may be fabricated as discussed in further detail hereinbelow.

Figure 3:
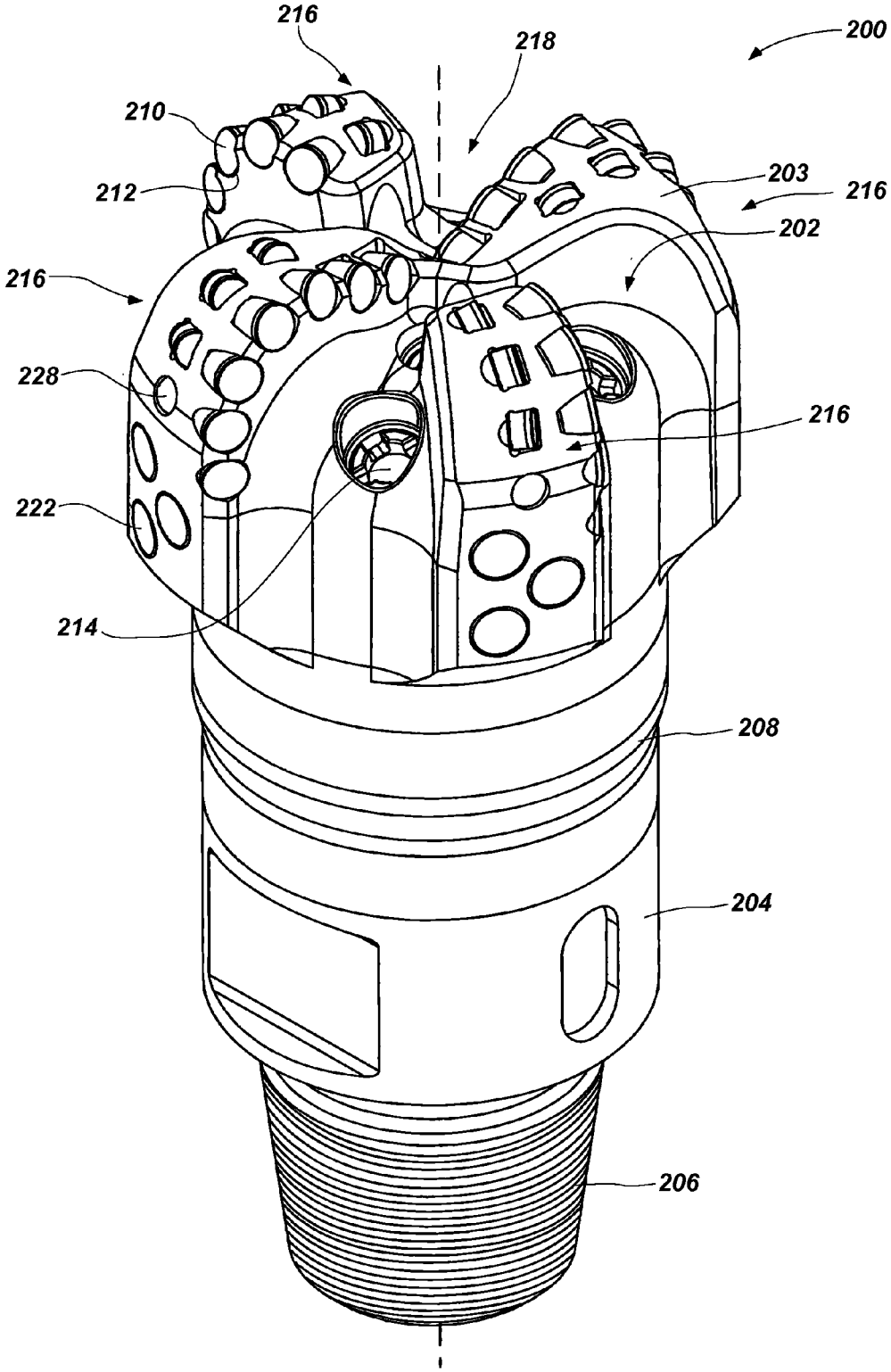
FIG. 3 is a perspective view of an embodiment of a fixed-cutter drill bit that may include one or more components comprising a cast particle-matrix composite material including a eutectic or near-eutectic composition.

FIG. 3 is a perspective view of a fixed-cutter earth-boring rotary drill bit 200 that includes a bit body 202 that may be formed using embodiments of methods of the present disclosure. The bit body 202 may be secured to a shank 204 having a threaded connection portion 206 (e.g., an American Petroleum Institute (API) threaded connection portion) for attaching the drill bit 200 to a drill string (not shown). In some embodiments, such as that shown in FIG. 3, the bit body 202 may be secured to the shank 204 using an extension 208. In other embodiments, the bit body 202 may be secured directly to the shank 204.

The bit body 202 may include internal fluid passageways (not shown) that extend between a face 203 of the bit body 202 and a longitudinal bore (not shown), which extends through the shank 204, the extension 208, and partially through the bit body 202. Nozzle inserts 214 also may be provided at the face 203 of the bit body 202 within the internal fluid passageways. The bit body 202 may further include a plurality of blades 216 that are separated by junk slots 218. In some embodiments, the bit body 202 may include gage wear plugs 222 and wear knots 228. A plurality of cutting elements 210 (which may include, for example, PDC cutting elements) may be mounted on the face 203 of the bit body 202 in cutting element pockets 212 that are located along each of the blades 216. The bit body 202 of the earth-boring rotary drill bit 200 shown in FIG. 3, or a portion of the bit body 202 (e.g., the blades 216 or portions of the blades 216) may comprise a cast particle-matrix composite material comprising a eutectic or near-eutectic composition, and may be fabricated as discussed in further detail hereinbelow.

Figure 4:
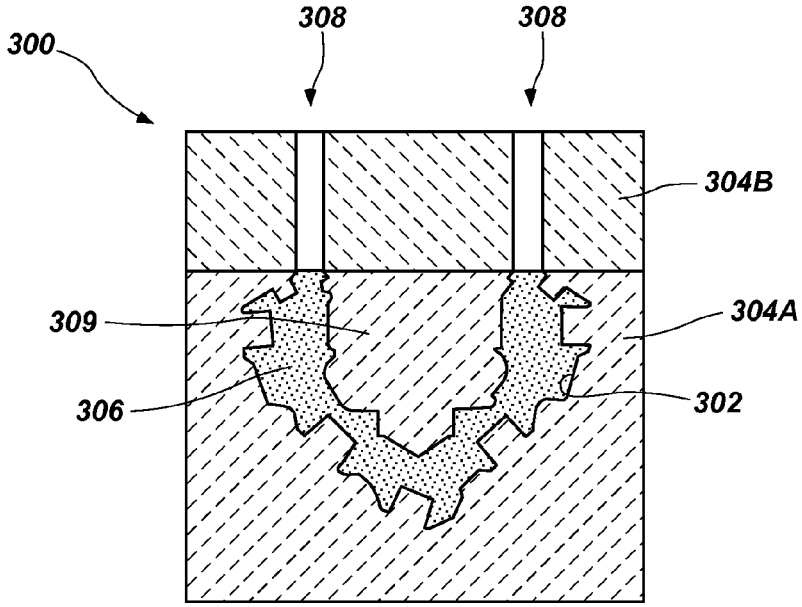
FIGS. 4 and 5 are used to illustrate embodiments of methods of the invention, and illustrate the casting of a roller cone like that shown in FIG. 2 within a mold.
Figure 5:
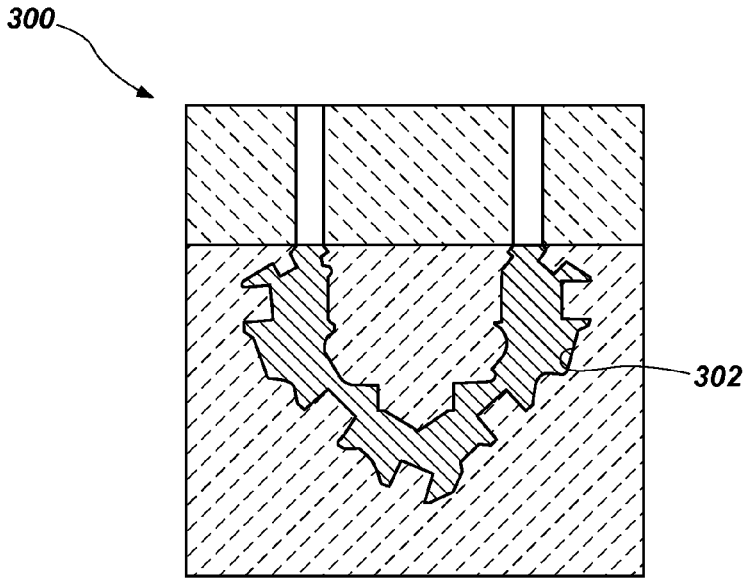

In accordance with some embodiments of the disclosure, earth-boring tools and/or components of earth-boring tools may be formed within a mold cavity using a casting process to cast a particle-matrix composite material comprising a eutectic or near-eutectic composition within the mold cavity. FIGS. 4 and 5 are used to illustrate the formation of a roller cone 122 like that shown in FIGS. 1 and 2 using such a casting process.

Referring to FIG. 4, a mold 300 may be provided that includes a mold cavity 302 therein. The mold cavity 302 may have a size and shape corresponding to the size and shape of the roller cone 122 or other portion or component of an earth-boring tool to be cast therein. The mold 300 may comprise a material that is stable and will not degrade at temperatures to which the mold 300 will be subjected during the casting process. The material of the mold 300 also may be selected to comprise a material that will not react with or otherwise detrimentally affect the material of the roller cone 122 to be cast within the mold cavity 302. As non-limiting examples, the mold 300 may comprise graphite or a ceramic material such as, for example, silicon oxide or aluminum oxide. After the casting process, it may be necessary to break or otherwise damage the mold 300 to remove the cast roller cone 122 from the mold cavity 302. Thus, the material of the mold 300 also may be selected to comprise a material that is relatively easy to break or otherwise remove from around the roller cone 122 to enable the cast roller cone 122 (or other portion or component of an earth-boring tool) to be removed from the mold 300. As shown in FIG. 4, the mold may comprise two or more components, such as a base portion 304A and a top portion 304B, that may be assembled together to form the mold 300. A bearing pin displacement member 309 may be used to define an interior void within the roller cone 122 to be cast within the mold 300 that is sized and configured to receive a bearing pin therein when the roller cone 122 is mounted on the bearing pin. In some embodiments, the bearing pin displacement member 309 may comprise a separate body, as shown in FIG. 4. In other embodiments, the bearing pin displacement member 309 may be an integral part of the top portion 304B of the mold 300.

Particulate matter 306 comprising a hard material such as a carbide (e.g., tungsten carbide), a nitride, a boride, etc., optionally may be provided within the mold cavity 302. As used herein, the term "hard material" means and includes any material having a Vickers Hardness of at least about 1200 (i.e., at least about 1200HV30, as measured according to ASTM Standard E384 (Standard Test Method for Knoop and Vickers Hardness of Materials, ASTM Int'l, West Conshohocken, Pa., 2010)).

After providing the particulate matter 306 within the mold cavity 302, a material comprising a eutectic or near-eutectic composition may be melted, and the molten material may be poured into the mold cavity 302 and allowed to infiltrate the space between the particulate matter 306 within the mold cavity 302 until the mold cavity 302 is at least substantially full. The molten material may be poured into the mold 300 through one or more openings 308 in the mold 300 that lead to the mold cavity 302.

In additional embodiments, no particulate matter 306 comprising hard material is provided within the mold cavity 302, and at least substantially the entire mold cavity 302 may be filled with the molten eutectic or near-eutectic composition to cast the roller cone 122 within the mold cavity 302.

In additional embodiments, particulate matter 306 comprising hard material is provided only at selected locations within the mold cavity 302 that correspond to regions of the roller cone 122 that are subjected to abrasive wear, such that those regions of the resulting roller cone 122 include a higher volume content of hard material compared to other regions of the roller cone 122 (formed from cast eutectic or near-eutectic composition without added particulate matter 306), which would have a lower volume content of hard material and exhibit a relatively higher toughness (i.e., resistance to fracturing).

In additional embodiments, the particulate matter 306 comprises both particles of hard material and particles of material or materials that will form a molten eutectic or near-eutectic composition upon heating the particulate matter 306 to a sufficient temperature to melt the material or materials that will form the molten eutectic or near-eutectic composition. In such embodiments, the particulate matter 306 is provided within the mold cavity 302. The mold cavity 302 may be vibrated to settle the particulate matter 306 to remove voids therein. The particulate matter 306 may be heated to a temperature sufficient to form the molten eutectic or near-eutectic composition. Upon formation of the molten eutectic or near-eutectic composition, the molten material may infiltrate the space between remaining solid particles in the particulate matter 306, which may result in settling of the particulate matter 306 and a decrease in occupied volume. Thus, excess particulate matter 306 also may be provided over the mold cavity 302 (e.g., within the openings 308 in the mold) to account for such settling that may occur during the casting process.

After casting the roller cone 122 within the mold cavity 302, the roller cone 122 may be removed from the mold 300. As previously mentioned, it may be necessary to break the mold 300 apart in order to remove the roller cone 122 from the mold 300.

The eutectic or near-eutectic composition may comprise a eutectic or near-eutectic composition of a metal and a hard material.

The metal of the eutectic or near-eutectic composition may comprise a commercially pure metal such as cobalt, iron, or nickel. In additional embodiments, the metal of the eutectic or near-eutectic composition may comprise an alloy based on one or more of cobalt, iron, and nickel. In such alloys, one or more elements may be included to tailor selected properties of the composition, such as strength, toughness, corrosion resistance, or electromagnetic properties.

The hard material of the eutectic or near-eutectic composition may comprise a ceramic compound, such as a carbide, a boride, an oxide, a nitride, or a mixture of one or more such ceramic compounds.

In some non-limiting examples, the metal of the eutectic or near-eutectic composition may comprise a cobalt-based alloy, and the hard material may comprise tungsten carbide. For example, the eutectic or near-eutectic composition may comprise from about 40% to about 90% cobalt or cobalt-based alloy by weight, from about 0.5 percent to about 3.8 percent by weight carbon, and the balance may be tungsten. In a further example, the eutectic or near-eutectic composition may comprise from about 55% to about 85% cobalt or cobalt-based alloy by weight, from about 0.85 percent to about 3.0 percent carbon by weight, and the balance may be tungsten. Even more particularly, the eutectic or near-eutectic composition may comprise from about 65% to about 78% cobalt or cobalt-based alloy by weight, from about 1.3 percent to about 2.35 percent carbon by weight, and the balance may be tungsten. For example, the eutectic or near-eutectic composition may comprise about 69% cobalt or cobalt-based alloy by weight (about 78.8 atomic percent cobalt), about 1.9% carbon by weight (about 10.6 atomic percent carbon), and about 29.1% tungsten by weight (about 10.6 atomic percent tungsten). As another example, the eutectic or near-eutectic composition may comprise about 75% cobalt or cobalt-based alloy by weight, about 1.53% carbon by weight, and about 23.47% tungsten by weight.

Once the eutectic or near-eutectic composition is heated to the molten state, the metal and hard material phases will not be distinguishable in the molten composition, which will simply comprise a generally homogenous molten solution of the various elements. Upon cooling the molten composition, however, phase segregation will occur and the metal phase and hard material phase may segregate from one another and solidify to form a composite microstructure that includes regions of the metal phase and regions of the hard material phase. Furthermore, in embodiments in which particulate matter 306 is provided within the mold 300 prior to casting the eutectic or near-eutectic composition in the mold cavity 302, additional phase regions resulting from the particulate matter 306 may also be present in the final microstructure of the resulting cast roller cone 122.

As the molten eutectic or near-eutectic composition is cooled and phase segregation occurs, metal and hard material phases may be formed again. Hard material phases may include metal carbide phases. For example, such metal carbide phases may be of the general formula $M_6C$ and $M_{12}C$, wherein M represents one or more metal elements and C represents carbon. As a particular example, in embodiments wherein a desirable hard material phase to be formed is monotungsten carbide (WC), the eta phases of the general formula $W_xCo_yC$, wherein x is from about 0.5 to about 6 and y is from about 0.5 to about 6 (e.g., $W_3Co_3C$ and $W_6Co_6C$) also may be formed. Such metal carbide eta phases tend to be relatively wear-resistant, but also more brittle compared to the primary carbide phase (e.g., WC). Thus, such metal carbide eta phases may be undesirable for some applications. In accordance with some embodiments of the disclosure, a carbon correction cycle may be used to adjust the stoichiometry of the resulting metal carbide phases in such a manner as to reduce (e.g., at least substantially eliminate) the resulting amount of such undesirable metal carbide eta phases (e.g., $M_6C$ and $M_{12}C$) in the cast roller cone 122 and increase the resulting amount of a desirable primary metal carbide phase (e.g., MC and/or $M_2C$) in the cast roller cone 122. By way of example and not limitation, a carbon correction cycle as disclosed in U.S. Pat. No. 4,579,713, which issued Apr. 1, 1986 to Lueth, the disclosure of which is incorporated herein in its entirety by this reference, may be used to adjust the stoichiometry of the resulting metal carbide phases in the cast roller cone 122.

Briefly, the roller cone 122 (or the mold 300 with the materials to be used to form the roller cone 122 therein) may be provided in a vacuum furnace together with a carbon-containing substance, and then heated to a temperature within the range extending from about 800° C. to about 1100° C., while maintaining the furnace under vacuum. A mixture of hydrogen and methane then may be introduced into the furnace. The percentage of methane in the mixture may be from about 10% to about 90% of the quantity of methane needed to obtain equilibrium of the following equation at the selected temperature and pressure within the furnace:

$$C_{solid}+2H_2 \leftrightarrows CH_4$$

Following the introduction of the hydrogen and methane mixture into the furnace chamber, the furnace chamber is maintained within the selected temperature and pressure range for a time period sufficient for the following reaction:

$$MC+2H_2 \leftrightarrows M+CH_4,$$

where M may be selected from the group of W, Ti, Ta, Hf and Mo, to substantially reach equilibrium, but in which the reaction:

$$C_{solid}+2H_2 \leftrightarrows CH_4,$$

does not reach equilibrium either due to the total hold time or due to gas residence time but, rather, the methane remains within about 10% and about 90% of the amount needed to obtain equilibrium. This time period may be from about 15 minutes to about 5 hours, depending upon the selected temperature. For example, the time period may be approximately 90 minutes at a temperature of about 1000° C. and a pressure of about one atmosphere.

The carbon correction cycle may be performed on the materials to be used to form the cast roller cone 122 prior to, or during the casting process in such a manner as to hinder or prevent the formation of the undesirable metal carbide eta phases (e.g., $M_6C$ and $M_{12}C$) in the cast roller cone 122. In additional embodiments, it may be possible to perform the carbon correction cycle after the casting process in such a manner as to convert undesirable metal carbide phases previously formed in the roller cone 122 during the casting process to more desirable metal carbide phases (e.g., MC and/or $M_2C$), although such conversion may be limited to regions at or proximate the surface of the roller cone 122.

In additional embodiments, an annealing process may be used to adjust the stoichiometry of the resulting metal carbide phases in such a manner as to reduce (e.g., at least substantially eliminate) the resulting amount of such undesirable metal carbide phases (e.g., $M_6C$ and $M_{12}C$) in the cast roller cone 122 and increase the resulting amount of a desirable primary metal carbide phase (e.g., MC and/or $M_2C$) in the cast roller cone 122. For example, the cast roller cone 122 may be heated in a furnace to a temperature of at least about 1200° C. (e.g., about 1225° C.) for at least about three hours (e.g., about 6 hours or more). The furnace may comprise a vacuum furnace, and a vacuum may be maintained within the furnace during the annealing process. For example, a pressure of about 0.015 millibar may be maintained within the vacuum furnace during the annealing process. In additional embodiments, the furnace may be maintained at about atmospheric pressure, or it may be pressurized, as discussed in further detail below. In such embodiments, the atmosphere within the furnace may comprise an inert atmosphere. For example, the atmosphere may comprise nitrogen or a noble gas.

During the processes described above for adjusting the stoichiometry of metal carbide phases within the roller cone 122, free carbon (e.g., graphite) that is present in or adjacent the roller cone 122 also may be absorbed and combined with metal (e.g., tungsten) to form a metal carbide phase (e.g., tungsten carbide), or combined into existing metal carbide phases.

In some embodiments, a hot isostatic pressing (HIP) process may be used to improve the density and decrease porosity in the cast roller cone 122. For example, during the casting process, an inert gas may be used to pressurize a chamber in which the casting process may be conducted. The pressure may be applied during the casting process, or after the casting process but prior to removing the cast roller cone 122 from the mold 300. In additional embodiments, the cast roller cone 122 may be subjected to a HIP process after removing the cast roller cone 122 from the mold 300. By way of example, the cast roller cone 122 may be heated to a temperature of from about 300° C. to about 1200° C. while applying an isostatic pressure to exterior surfaces of the roller cone 122 of from about 7.0 MPa to about 310,000 MPa (about 1 ksi to about 45,000 ksi). Furthermore, a carbon correction cycle as discussed hereinabove may be incorporated into the HIP process such that the carbon correction cycle is performed either immediately before or after the HIP process in the same furnace chamber used for the HIP process.

In additional embodiments, a cold isostatic pressing process may be used to improve the density and decrease porosity in the cast roller cone 122. In other words, the cast roller cone 122 may be subjected to isostatic pressures of at least about 10,000 MPa while maintaining the roller cone 122 at a temperature of about 300° C. or less.

After forming the roller cone 122, the roller cone 122 may be subjected to one or more surface treatments. For example, a peening process (e.g., a shot peening process, a rod peening process, or a hammer peening process) may be used to impart compressive residual stresses within the surface regions of the roller cone 122. Such residual stresses may improve the mechanical strength of the surface regions of the roller cone 122, and may serve to hinder cracking in the roller cone 122 during use in drilling that might result from, for example, fatigue.

Casting of articles can allow the formation of articles having relatively complex geometric configurations that may not be attainable by other fabrication methods. Thus, by casting earth-boring tools and/or components of earth-boring tools as disclosed herein, earth-boring tools and/or components of earth-boring tools may be formed that have designs that are relatively more complex geometrically compared to previously fabricated earth-boring tools and/or components of earth-boring tools.

Additional non-limiting example embodiments of the disclosure are described below.

Embodiment 1

A method of forming at least a portion of an earth-boring tool, comprising providing particulate matter comprising a hard material in a mold cavity, melting a metal and the hard material to form a molten composition comprising a eutectic or near-eutectic composition of the metal and the hard material, casting the molten composition to form the at least a portion of an earth-boring tool within the mold cavity, and adjusting a stoichiometry of at least one hard material phase of the at least a portion of the earth-boring tool.

Embodiment 2

The method of Embodiment 1, wherein adjusting a stoichiometry of at least one hard material phase of the at least a portion of the earth-boring tool comprises converting at least one of an $M_6C$ phase and an $M_{12}C$ phase to at least one of an MC phase and an $M_2C$ phase, wherein M is at least one metal element and C is carbon.

Embodiment 3

The method of Embodiment 2, wherein converting at least one of an $M_6C$ phase and an $M_{12}C$ phase to at least one of an MC phase and an $M_2C$ phase comprises converting $W_xCo_yC$ to WC, wherein x is from about 0.5 to about 6 and y is from about 0.5 to about 6.

Embodiment 4

The method of any of Embodiments 1 through 3, wherein melting a metal and a hard material to form a molten composition comprises melting a mixture comprising from about 40% and about 90% cobalt or cobalt-based alloy by weight and from about 0.5% to about 3.8% carbon by weight, wherein a balance of the mixture is at least substantially comprised of tungsten.

Embodiment 5

The method of any of Embodiments 1 through 4, wherein melting a metal and a hard material to form a molten composition comprises melting a mixture comprising from about 55% to about 85% cobalt or cobalt-based alloy by weight and from about 0.85% to about 3.0% carbon by weight, wherein a balance of the mixture is at least substantially comprised of tungsten.

Embodiment 6

The method of any of Embodiments 1 through 5, wherein melting a metal and a hard material to form a molten composition comprises melting a mixture comprising from about 65% to about 78% cobalt or cobalt-based alloy by weight and from about 1.3% to about 2.35% carbon by weight, wherein a balance of the mixture is at least substantially comprised of tungsten.

Embodiment 7

The method of any of Embodiments 1 through 6, wherein melting a metal and a hard material to form a molten composition comprises melting a mixture comprising about 69% cobalt or cobalt-based alloy by weight, about 1.9% carbon by weight, and about 29.1% tungsten by weight.

Embodiment 8

The method of any of Embodiments 1 through 7, wherein melting a metal and a hard material to form a molten composition comprises melting about 75% cobalt or cobalt-based alloy by weight, about 1.53% carbon by weight, and about 23.47% tungsten by weight.

Embodiment 9

The method of any of Embodiments 1 through 8, further comprising pressing the at least a portion of the earth-boring tool after casting the molten composition to form at least a portion of the earth-boring tool within the mold cavity.

Embodiment 10

The method of any of Embodiments 1 through 9, further comprising treating at least a surface region of the at least a portion of the earth-boring tool to provide residual compressive stresses within the at least a surface region of the at least a portion of the earth-boring tool.

Embodiment 11

The method of Embodiment 10, wherein treating at least the surface region of the at least a portion of the earth-boring tool comprises subjecting the at least a surface region of the at least a portion of the earth-boring tool to a peening process.

Embodiment 12

A method of forming a roller cone of an earth-boring rotary drill bit comprising forming a molten composition comprising a eutectic or near-eutectic composition of cobalt and tungsten carbide, casting the molten composition within a mold cavity, solidifying the molten composition within the mold cavity to form the roller cone, and converting an eta-phase region within the roller cone to at least one of WC and $W_2C$.

Embodiment 13

The method of Embodiment 12, wherein forming a molten composition comprises forming a molten composition comprising about 69% cobalt or cobalt-based alloy by weight, about 1.9% carbon by weight, and about 29.1% tungsten by weight.

Embodiment 14

The method of Embodiment 12 or Embodiment 13, further comprising pressing the roller cone after casting the molten composition within the mold cavity.

Embodiment 15

The method of any of Embodiments 12 through 14, further comprising treating at least a surface region of the roller cone to provide residual compressive stresses within the at least a surface region of the roller cone.

Embodiment 16

The method of Embodiment 15, wherein treating at least a surface region of the roller cone comprises subjecting the at least the surface region of the roller cone to a peening process.

Although the foregoing description contains many specifics, these are not to be construed as limiting the scope of the present invention, but merely as providing certain exemplary embodiments. Similarly, other embodiments of the invention may be devised that do not depart from the scope of the present invention. For example, features described herein with reference to one embodiment also may be provided in others of the embodiments described herein. The scope of the invention is, therefore, indicated and limited only by the appended claims and their legal equivalents, rather than by the foregoing description. All additions, deletions, and modifications to the invention, as disclosed herein, which fall within the meaning and scope of the claims, are encompassed by the present invention.

What is claimed is:

1. A method of forming at least a portion of an earth-boring tool, comprising:

providing particulate matter comprising a hard material in a mold cavity;

melting a metal and the hard material to form a molten composition comprising a eutectic or near-eutectic composition of the metal and the hard material;

casting the molten composition to form the at least a portion of an earth-boring tool within the mold cavity; and adjusting a stoichiometry of at least one hard material phase of the at least a portion of the earth-boring tool.

2. The method of claim 1, wherein adjusting a stoichiometry of at least one hard material phase of the at least a portion of the earth-boring tool comprises converting at least one of an $M_6C$ phase and an $M_{12}C$ phase to at least one of an MC phase and an $M_2C$ phase, wherein M is at least one metal element and C is carbon.

3. The method of claim 2, wherein converting at least one of an $M_6C$ phase and an $M_{12}C$ phase to at least one of an MC phase and an $M_2C$ phase comprises converting $W_xCo_yC$ to WC, wherein x is from about 0.5 to about 6 and y is from about 0.5 to about 6.

4. The method of claim 1, wherein melting a metal and a hard material to form a molten composition comprises melting a mixture comprising from about 40% and about 90% cobalt or cobalt-based alloy by weight and from about 0.5% to about 3.8% carbon by weight, wherein a balance of the mixture is at least substantially comprised of tungsten.

5. The method of claim 1, wherein melting a metal and a hard material to form a molten composition comprises melting a mixture comprising from about 55% to about 85% cobalt or cobalt-based alloy by weight and from about 0.85% to about 3.0% carbon by weight, wherein a balance of the mixture is at least substantially comprised of tungsten.

6. The method of claim 1, wherein melting a metal and a hard material to form a molten composition comprises melting a mixture comprising from about 65% to about 78% cobalt or cobalt-based alloy by weight and from about 1.3% to about 2.35% carbon by weight, wherein a balance of the mixture is at least substantially comprised of tungsten.

7. The method of claim 1, wherein melting a metal and a hard material to form a molten composition comprises melting a mixture comprising about 69% cobalt or cobalt-based alloy by weight, about 1.9% carbon by weight, and about 29.1% tungsten by weight.

8. The method of claim 7, wherein melting a metal and a hard material to form a molten composition comprises melting about 75% cobalt or cobalt-based alloy by weight, about 1.53% carbon by weight, and about 23.47% tungsten by weight.

9. The method of claim 1, further comprising pressing the at least a portion of the earth-boring tool after casting the molten composition to form the at least a portion of the earth-boring tool within the mold cavity.

10. The method of claim 1, further comprising treating at least a surface region of the at least a portion of the earth-boring tool to provide residual compressive stresses within the at least a surface region of the at least a portion of the earth-boring tool.

11. The method of claim 10, wherein treating at least a surface region of the at least a portion of the earth-boring tool comprises subjecting the at least a surface region of the at least a portion of the earth-boring tool to a peening process.

12. A method of forming a roller cone of an earth-boring rotary drill bit, comprising:

forming a molten composition comprising a eutectic or near-eutectic composition of cobalt and tungsten carbide;

casting the molten composition within a mold cavity;

solidifying the molten composition within the mold cavity to form the roller cone; and converting an eta-phase region within the roller cone to at least one of WC and $W_2C$.

13. The method of claim 12, wherein forming a molten composition comprises forming a molten composition comprising about 69% cobalt or cobalt-based alloy by weight, about 1.9% carbon by weight, and about 29.1% tungsten by weight.

14. The method of claim 12, further comprising pressing the roller cone after casting the molten composition within the mold cavity.

15. The method of claim 12, further comprising treating at least a surface region of the roller cone to provide residual compressive stresses within the at least a surface region of the roller cone.

16. The method of claim 15, wherein treating at least a surface region of the roller cone comprises subjecting the at least the surface region of the roller cone to a peening process.

* * * * *